United States Patent [19]

Usuda et al.

[11] Patent Number: 4,790,237

[45] Date of Patent: Dec. 13, 1988

[54] DAMPER

[75] Inventors: Masashi Usuda; Kiyoshi Shimizu; Eiji Iwata; Hideo Yamada; Kazutaka Onozuka, all of Tokyo; Toshio Kuno, Fukuoka; Hideo Kuno, Fukuoka; Yukio Kuno, Fukuoka, all of Japan

[73] Assignees: Takenaka Corporation, Osaka; Kyoritsu Co., Ltd., Fukuoka, both of Japan

[21] Appl. No.: 835,227

[22] Filed: Mar. 3, 1986

[30] Foreign Application Priority Data

Mar. 5, 1985 [JP] Japan ..... 60-31750[U]
Mar. 5, 1985 [JP] Japan ..... 60-31751[U]
Mar. 7, 1985 [JP] Japan ..... 60-33052[U]

[51] Int. Cl.[4] ..... F24F 7/02; F24F 13/10

[52] U.S. Cl. ..... 98/42.16; 49/40; 49/109; 98/42.19; 98/85; 137/870

[58] Field of Search ..... 49/40, 109; 98/42.16, 98/42.19, 42.23, 85; 137/601, 862, 870

[56] References Cited

U.S. PATENT DOCUMENTS

| | | | |
|---|---|---|---|
| 902,509 | 10/1908 | Speer | 98/42.16 |
| 1,291,184 | 1/1919 | Schulz | 98/42.16 X |
| 1,630,978 | 5/1927 | Sobel | 98/85 |
| 1,695,064 | 12/1928 | Schnoor | 98/85 X |
| 1,921,652 | 8/1933 | Bohnert | 49/40 X |
| 2,203,444 | 6/1940 | Schilling | 98/42.19 |
| 2,319,178 | 5/1943 | Wrona | 49/109 X |
| 2,329,468 | 9/1943 | Hardgrove | 137/601 |
| 2,719,475 | 10/1955 | Royall | 98/42.19 X |
| 3,198,235 | 8/1965 | Maskell | 137/601 |
| 4,397,225 | 8/1983 | Patton | 98/42.23 |

FOREIGN PATENT DOCUMENTS

| | | | |
|---|---|---|---|
| 3003664 | 8/1981 | Fed. Rep. of Germany | 137/870 |
| 47-38704 | 9/1972 | Japan . | |
| 55-27264 | 7/1980 | Japan . | |
| 57-207737 | 12/1982 | Japan . | |
| 58-16828 | 2/1983 | Japan . | |
| 58-22624 | 2/1983 | Japan . | |
| 58-37441 | 3/1983 | Japan . | |
| 59-49117 | 4/1984 | Japan . | |
| 59-65325 | 5/1984 | Japan . | |
| 59-86529 | 6/1984 | Japan . | |
| 59-131402 | 9/1984 | Japan . | |
| 60-21646 | 2/1985 | Japan . | |
| 62-3640 | 1/1987 | Japan . | |

*Primary Examiner*—Harold Joyce
*Attorney, Agent, or Firm*—Burns, Doane, Swecker & Mathis

[57] ABSTRACT

A damper for use in controlling the flow rate or direction of a flow of air or fumes flowing out from a room or space or flowing through a ventilation system, including a housing having at least one inlet opening. The housing has a tubular side wall in which are provided a plurality of outlet apertures opened and closed by associated closure members which are adapted to swing to and away from the side wall, preferable inwardly of the housing. The total flow area of the outlet apertures may be extended to a desired degree by increasing the axial length and diameter of the side wall of the housing, whereby the flow resistance and pressure drop across the damper are reduced.

8 Claims, 3 Drawing Sheets

DAMPER

BACKGROUND OF THE INVENTION

1. Field of the Invention

The present invention relates to a damper for controlling a flow of air or fumes flowing out from a room or space of a building or other structures or flowing through a ventilation or air-conditioning system.

2. Description of the Related Art

Conventional dampers comprise one or more swingable shutter blades which are adapted to control the flow of air therethrough. The shutter blades are generally arranged in such a manner that in their closed position the blades are oriented perpendicular to the direction of air flow.

The problem of the prior art damper design is that the flow area of the damper is limited, thereby increasing the flow resistance therethrough.

SUMMARY OF THE INVENTION

An object of the present invention is to provide a damper having an increased flow area.

Another object of the invention is to reduce the flow resistance and pressure drop across the damper.

A further object of the invention is to provide a damper having an increased inner volume sufficient to ensure a smooth and unobstructed flow of air or fumes therethrough.

Still another object of the present invention is to provide a damper having a simple and durable structure and which is easy to operate.

Another object of the invention is to facilitate maintenance and repair services of the damper.

According to one aspect of the invention, there is provided a damper having an enclosed hollow housing having an inlet opening. The housing comprises a tubular side wall provided with a plurality of outlet openings which are opened and closed by respective closure members.

Air from a room or space passes through the inlet opening and flows into the tubular housing in the axial direction. The air is then directed through the outlet openings provided through the tubular side wall of the housing and leaves the inner cavity of the housing. Since the outlet openings are provided in the side wall of the housing, it is possible to increase the total flow area of the outlet openings by simply increasing the axial length and the diameter of the side wall. The housing has a large inner volume because the side wall has a tubular configuration. For these reasons, it is possible to reduce the flow resistance through the damper and ensure an unobstructed smooth air flow.

According to another aspect of the invention, there is provided a damper having a drive mechanism which is adapted to conjointly move the closure members.

According to a further aspect of the invention, there is provided a damper comprising a housing having a tubular side wall. An inlet aperture and a pair of outlet apertures are provided through the side wall. The outlet apertures are controlled by a pair of corresponding closure members which are operated in such a manner that one of the outlet apertures is opened and closed in response to the other of the outlet apertures being closed and opened.

DESCRIPTION OF THE PREFERRED EMBODIMENTS

Figure 1:
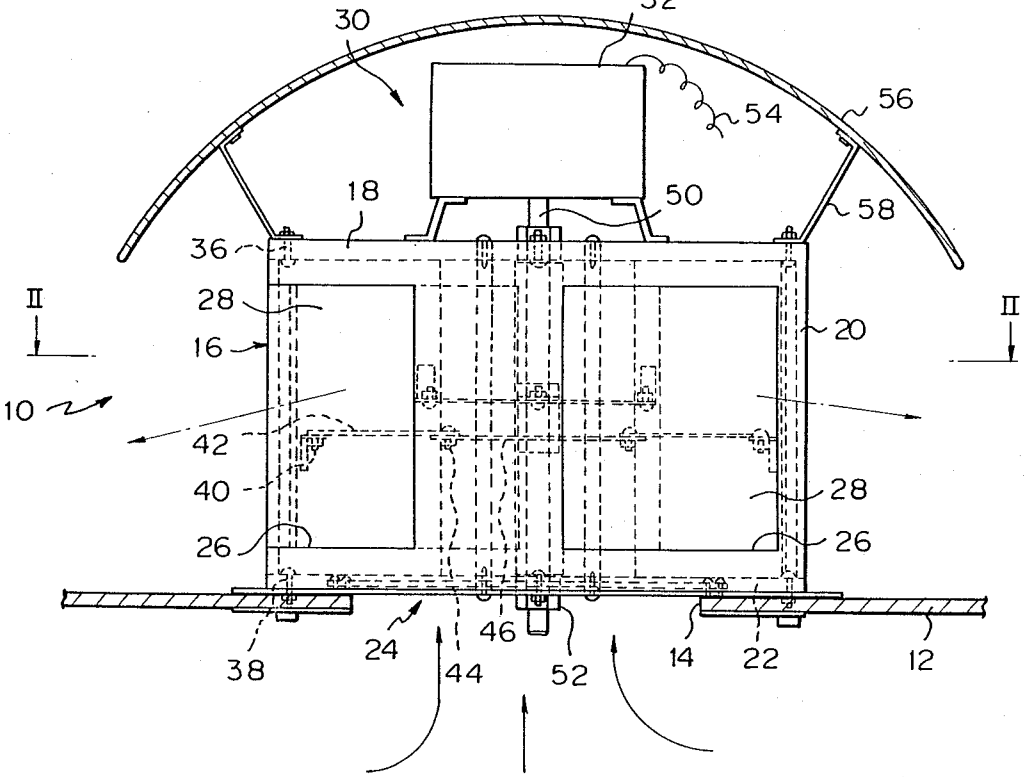
FIG. 1 is a side elevational view, partly cut away, of the damper according to the first embodiment of the invention as mounted on a roof of a building structure.
Figure 2:
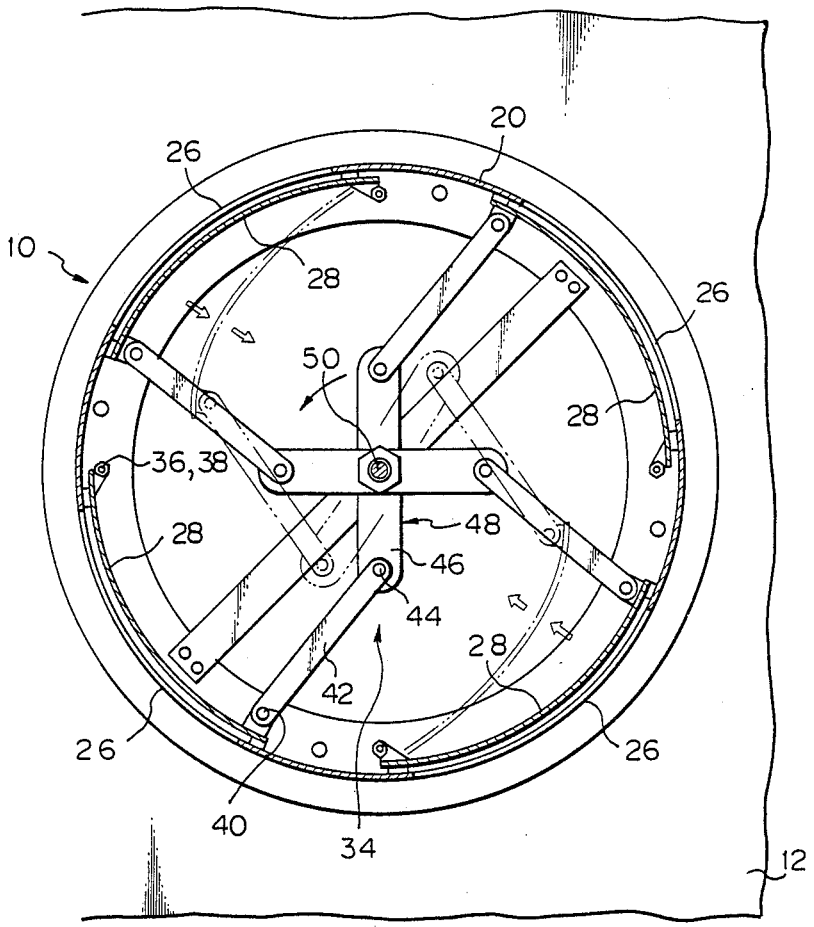
FIG. 2 is a cross-sectional view taken along the line II—II of FIG. 1 and showing by the dotted line the position of the closure members as swung radially inwardly of the housing.

Referring to FIGS. 1 and 2, there is shown a damper 10 as mounted on a roof 12 of a building structure. The damper 10 is designed to control the flow rate of or shut off exhausted air flowing from a room or space within the building structure through an opening 14 in the roof 12.

The damper 10 comprises a housing 16 which includes flat top wall 18, a cylindrical side wall 20, and a flat bottom wall 22. The bottom wall 22 has an inlet aperture 24 therethrough aligned with the exhaust opening 14. In the illustrated embodiment, the side wall 20 is provided with four identical recesses 26 serving as outlet apertures. These outlet apertures 26 are circumferentially spaced apart from each other at an equal distance. The total flow area of the outlet apertures 26 is determined to be greater than the horizontal cross-sectional area of the side wall 20, so that the air flowed into the housing may be discharged through the outlet apertures 26 to the ambient environment without any substantial pressure drop.

The outlet apertures 26 are opened and closed by associated closure members 28 which are operated by a drive means 30 having a drive unit 32 and a linkage 34. Since the four closure members 28 and parts of the linkage associated therewith are identical, only one of them will be described hereinafter. The closure member 28 has an arcuate configuration to conform to the inner periphery of the side wall 20. In the illustrated embodiment, the closure member 28 is shown as being placed inside of the side wall 20 and is adapted to swing inwardly. However, the closure member 28 may alternatively be arranged to be swung outwardly from the side wall 20. In the illustrated embodiment, the end of the closure member 28 is pivoted at 36 and 38 to the top and bottom walls 18 and 22 of the housing 16. The other end of the closure member 28 is pivoted at 40 to a link bar 42 which is in turn pivoted at 44 to an arm 46 of a lever 48 which is rigidly secured to an output shaft 50 of the drive unit 32. The shaft 50 of the drive unit 32 passes rotatably through the top wall 18 and extends downward coaxially with the central axis of the housing 16. The lower part of the shaft 50 may be journaled in a bearing 52 suitably supported by a spider structure, not shown.

The drive unit 32 may comprise an electric servo motor with a reduction gear mechanism and may be controlled over a line 54 by a control board (not shown) remote from the damper 10.

A dome shaped roof or hood 56 is mounted to the top wall 18 through a suitable number of supports 58.

In FIG. 2, all the four closure members 28 are shown as being in their closed position. It will be understood that when the drive unit 32 is actuated to rotate the output shaft 50 in the counterclockwise direction, the levers 48 are turned in the same direction to pull the associated link bars 42 thereby causing all the closure members 28 to swing conjointly and inwardly away from the side wall 20 into a wide open position shown by the dotted line (the wide open position being shown in FIG. 2 for only two of the closure members for the purposes of simplicity of the drawing). In this manner, all the four outlet apertures 26 are fully opened, whereby the air or fumes entering from a room upwardly into the housing 16 is allowed to flow out through the outlet apertures without being obstructed by the closure members 28. In any intermediate position of the closure members 28, the flow rate of air flow is controlled depending on the opening thereof.

It should be appreciated that since in this embodiment the outlet apertures 26 are provided in the side wall 20 which is perpendicular to the inlet aperture 24, the total flow area of the outlet apertures may be considerably increased by increasing the diameter or axial length or both of the side wall 20, thereby reducing the flow resistance through the damper 10. The overall height of the damper may be reduced by increasing the diameter thereof. The housing has an inner volume large enough to permit the closure members to swing sufficiently away from the side wall 20. This ensures the air can flow smoothly without causing any appreciable pressure drop. The large inner volume of the housing and the large flow area of the outlet apertures enables accommodation of a high flow rate of air or fumes. The roof 56 protects the parts of the damper from rain and sunlight. Maintenance and repair of the drive unit 32 may be readily carried out because the drive unit is positioned above the housing and access thereto is easy for one standing on the building roof 12. The side wall 20 of the housing 16 need not necessarily be cylindrical. In modified versions of the embodiment, the side wall may have a square, rectangular, hexagonal, or other cross-section.

Figure 3:
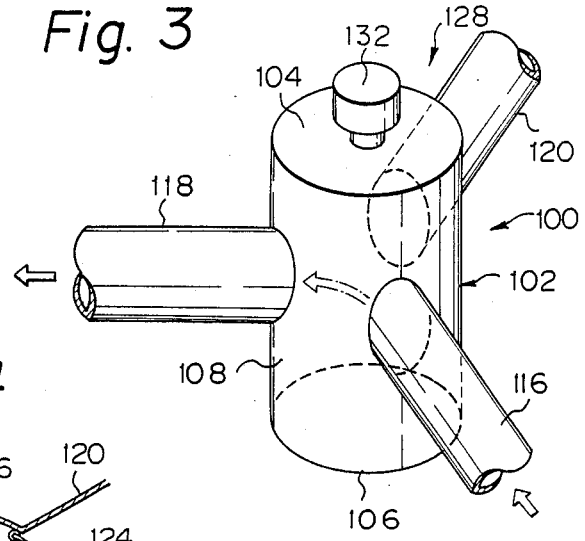
FIG. 3 is a perspective view of the damper according to the second embodiment of the invention.
Figure 4:
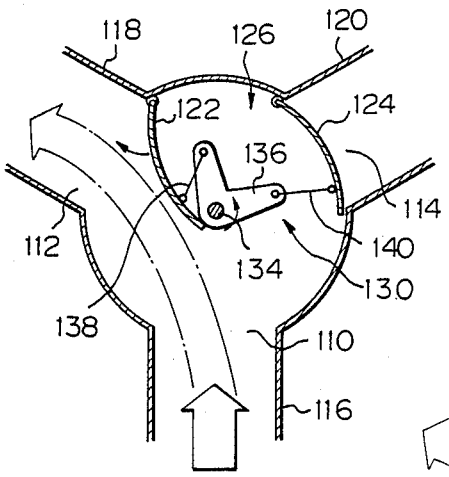
FIG. 4 is a horizontal cross-sectional view of the damper shown in FIG. 3 and illustrates one of the closure members in a wide open position and the other thereof in a fully closed position.

FIGS. 3 and 4 illustrate a second embodiment of the invention. The flow control damper 100 has a housing 102 consisting of a top wall 104, a bottom wall 106, and a cylindrical side wall 108 interconnecting the top and bottom walls. The side wall 108 of the housing is provided with an inlet aperture 110 and a pair of outlet apertures 112 nd 114, these apertures 110, 112 and 114 being spaced circumferentially at an equal angular distance from each other. The inlet aperture 110 is connected to an inlet duct 116 communicated with a building space or room. The outlet apertures 112 and 114 are connected respectively to outlet ducts 118 and 120, one of which may be communicated with the ambient atmosphere, the other being connected, for example, to an air-conditioning system. The damper 100 is intended to switch over the incoming exhausted air to be selectively directed to either of the outlet ducts 118 and 120 or o distribute the exhausted air to both outlet ducts in any desired proportion. The housing is so sized that the transverse cross-sectional area thereof is substantially greater than either of the flow area of the inlet aperture 110 and the total flow area of the outlet apertures 112 and 114.

A pair of arcuate closure members 122 and 124 cooperate with the side wall 108 of the housing 102 to open and close the outlet apertures 112 and 114, respectively. The closure members 122 and 124 are hinged to the housing at their ends adjacent with each other as shown in FIG. 4 and are adapted to be moved by a drive mechanism 126 including a drive unit 128 and a linkage 130. The drive unit 128 comprises a servo motor 132 having a reduction gear mechanism incorporated therein, and an output shaft 134 extending coaxially with the axis of the housing. The linkage 130 includes a bell crank 136 rigidly secured to the shaft 134, and a pair of link bars 138 and 140 pivoted, respectively, to the free ends of the closure members and the bell crank.

With this arrangement, when the servo motor 132 is energized to rotate the output shaft 134 in the clockwise direction as viewed in FIG. 4, the closure member 122 will be fully opened with the other closure member 124 fully closed, thereby directing the exhausted air to flow solely through the outlet aperture 112 to the outlet duct 118. Conversely, if the motor is rotated in the reverse direction, the closure member 122 will be fully closed with the closure member 124 fully opened, thereby switching the air to flow toward the outlet duct 120. In any intermediate angular position of the output shaft 134, the closure members 122 and 124 are swung in such a manner that the total opening thereof is constant, thereby distributing the incoming exhausted air to both outlet ducts 118 and 120 depending on the amount of opening of the closure members.

It should be noted that the housing 102 has a large inner volume. This enables, in the first place, the incoming air to smoothly move within the housing and, in the second place, the closure members 122 and 124 to be swung inwardly away from the side wall 108 widely enough to ensure the air flows through the outlet apertures 112 and 114 without being obstructed by the closure members. Thus, the flow resistance and pressure drop across the damper is reduced. It should also be appreciated that the damper has a unitary housing in which are provided two outlet apertures controlled by closure members driven by a common single drive mechanism. Thus, the damper structure is much simplified, as compared with the conventional arrangement wherein one damper is needed at each juncture of the inlet duct and the outlet duct.

Figure 5:
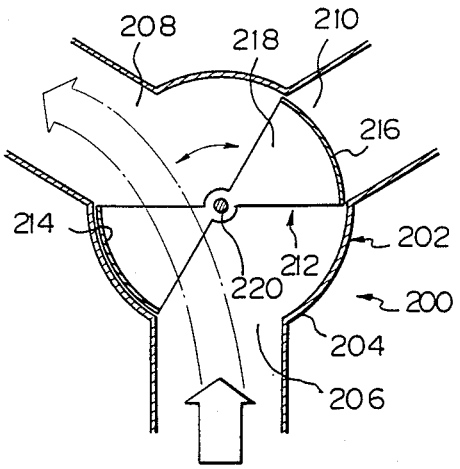
FIG. 5 is a view similar to FIG. 4 but showing a modified embodiment, the rotary shutter member of the damper being shown as being in a position wherein the air flow is directed to one of the outlet openings.

FIG. 5 shows a modified version of the embodiment illustrated in FIGS. 3 and 4. The damper 200 comprises a housing 202 with a cylindrical side wall 204 having an inlet aperture 206 and a pair of outlet apertures 208 and 210, similar to the preceding embodiment. In this embodiment, the outlet apertures are controlled by a shutter member 212 having a pair of diametrically opposed arcuate closure members 214 and 216 carried by a support plate 218 which is rigidly secured at its center to a drive shaft 220 for rotation therewith. The outlet apertures 208 and 210 and the closure members 214 and 216, respectively, extend circumferentially through an angle of about 60°.

With this arrangement, the outlet aperture 208 is fully opened and the outlet aperture 210 fully closed, when the shutter member 212 is in the angular position as shown. When the drive unit is operated to rotate the shutter member 212 through 60° in the clockwise direction, the outlet aperture 208 will be fully closed with the outlet aperture 210 fully opened. In the intermediate position of the shutter member 212, the total flow area of the two outlet apertures 208 and 210 will be kept constant regardless of the angular position of the shutter member, so that the exhausted air admitted within the damper housing will be distributed to the outlet apertures at a predetermined proportion depending upon the angular position of the shutter member 212.

What is claimed is:

1. A self-contained, motorized damper adapted to be removably mounted on a roof of a building comprising:

an enclosed hollow housing having a circularly tubular side wall, an annular bottom wall arranged perpendicularly to said side wall for mounting said hollow housing onto the roof of the building, a single aperture defined in the center of said bottom wall for admitting air from a space of the building, a plurality of outlet apertures formed in said tubular side wall for allowing said air to flow out of said housing, the total flow area of said outlet apertures being greater than that of said single inlet aperture, and a top wall arranged on said side wall in axially opposed relationship to said bottom wall;

a plurality of movable closure members mounted on said housing adjacent respective ones of said outlet apertures for openably closing said outlet apertures in order to control the flow of air flowing from said housing; and actuating means for conjointly moving said closure members from a first position wherein all of said closure members close said respective outlet apertures, to a second position wherein all of said members open said respective outlet apertures, said actuating means including a drive motor mounted on the center of said top wall of said hollow housing, a rotatably driven shaft extending from said motor coaxially into said hollow housing, lever means connected to said shaft, and a linkage mechanism connected between said lever and said plurality of movable closure members to conjointly move said closure members in response to rotation of said shaft.

2. A unitary damper adapted for being removably mounted on a roof of a building according to claim 1, wherein said outlet apertures are circumferentially spaced apart from each other at equal angular distances, each of said closure members having an arcuate shape to conform to an arcuate shape of said outlet apertures.

3. A self-contained damper adapted for being removably mounted on a roof of a building according to claim 1, wherein said drive motor comprises an electric servo motor capable of controlling an amount of rotation of said shaft around a longitudinal axis thereof, thereby controlling a flow rate of said air flowing out of said housing.

4. A self-contained damper adapted for being removably mounted on a roof of a building according to claim 1, wherein said total flow area of said outlet apertures is greater than the transverse cross-sectional area of said hollow housing.

5. A self-contained damper adapted for being removably mounted on a roof of a building according to claim 1, wherein said plurality of outlet apertures comprises four outlet apertures circumferentially spaced apart by 90 degrees.

6. A self-contained, motorized dampler for use in a ventilation system for a building having a room to be ventilated, said damper comprising:

an enclosed hollow housing having a bottom annular wall to be used for mounting said damper on a roof of said building, and a circular cylindrical side wall extending substantially at a right angle thereto;

said annular bottom defining in a center thereof an aperture for admitting air from the room into said hollow housing;

said side wall having a plurality of outlet apertures spaced apart circumferentially at equal angular distances from each other;

the total flow area of said outlet apertures being greater than the transverse cross-sectional area defined by said side wall;

a plurality of closure members mounted on said housing adjacent respective ones of said outlet apertures so as to close and open said outlet apertures in response to a requirement for ventilation of the room of the building;

said closure members each being hinged at a first end thereof to said hollow housing for swinging between a first position wherein said closure members are brought into registration with said side wall to close said outlet apertures, and a second position wherein said closure members are swung inwardly away from said side wall to open said outlet apertures; and actuating means mounted on said housing and including a drive motor for conjointly and adjustably swinging said closure members in response to said requirement of ventilation between said first and second positions;

said drive motor fixedly mounted on said housing and having a rotatable shaft extending within said housing along a central axis of said side wall, said rotatable shaft having a radial lever member fixed thereto; and a linkage assembly arranged between said lever member and said closure members for conjointly swinging said closure members by an amount corresponding to the amount of rotation of said shaft.

7. A self-contained damper according to claim 6, wherein said linkage assembly comprises, for each of said closure members, a link bar pivoted at an end thereof to an outer end of said radial lever member and at the other end thereof to a second end of said closure member.

8. A self-contained damper according to claim 7, wherein said housing comprises a horizontal top wall supporting said motor, and further comprising a roof member provided above said top wall for covering said motor and said housing.

* * * * *